US010511103B2

(12) United States Patent
Noh et al.

(10) Patent No.: US 10,511,103 B2
(45) Date of Patent: Dec. 17, 2019

(54) ANTENNA MODULE AND PORTABLE DEVICE HAVING SAME

(71) Applicant: AMOTECH CO., LTD., Incheon (KR)

(72) Inventors: Jin-Won Noh, Gwangju (KR); Hyung-Il Baek, Gyeonggi-do (KR); Beom-Jin Kim, Incheon (KR); Ki-Sang Lim, Incheon (KR); Yong-Ho Hwang, Incheon (KR)

(73) Assignee: AMOTECH CO., LTD., Incheon (KR)

( * ) Notice: Subject to any disclaimer, the term of this patent is extended or adjusted under 35 U.S.C. 154(b) by 0 days.

(21) Appl. No.: 15/556,951

(22) PCT Filed: Mar. 10, 2016

(86) PCT No.: PCT/KR2016/002417
§ 371 (c)(1),
(2) Date: Sep. 8, 2017

(87) PCT Pub. No.: WO2016/144122
PCT Pub. Date: Sep. 15, 2016

(65) Prior Publication Data

US 2018/0248271 A1 Aug. 30, 2018

(30) Foreign Application Priority Data

Mar. 10, 2015 (KR) ..... 10-2015-0033405
Feb. 5, 2016 (KR) ..... 10-2016-0015179

(51) Int. Cl.
*H01Q 21/00* (2006.01)
*H01Q 25/00* (2006.01)
(Continued)

(52) U.S. Cl.
CPC ..... *H01Q 25/00* (2013.01); *H01Q 1/243* (2013.01); *H01Q 7/00* (2013.01); *H01Q 1/2208* (2013.01)

(58) Field of Classification Search
CPC ..... H01Q 1/243; H01Q 7/06; H01Q 25/00; H01Q 7/00
See application file for complete search history.

(56) References Cited

U.S. PATENT DOCUMENTS

2003/0107523 A1 6/2003 Yahata et al.
2005/0162331 A1* 7/2005 Endo ..... G06K 7/10336 343/788
2013/0135165 A1* 5/2013 Yamaguchi ..... H01Q 7/06 343/788

FOREIGN PATENT DOCUMENTS

JP 2003-234615 A 8/2003
KR 10-1998-0012707 A 4/1998
(Continued)

*Primary Examiner* — Dieu Hien T Duong
(74) *Attorney, Agent, or Firm* — Baker & Hostetler LLP

(57) ABSTRACT

The present invention suggests an antenna module in which a radiation pattern is alternately formed on an upper surface and a lower surface of a shielding sheet to be wound on the shielding sheet in a vertical direction, and a portable device having the same. In the suggested antenna module, the radiation pattern is alternately formed on the upper surface and the lower surface of the shielding sheet in the vertical direction of the shielding sheet, and the portable device comprises the antenna module having a radiation pattern formed along a short side direction of a back cover formed of a metal material, and mounted to be biased from the center of the back cover to the short side direction.

12 Claims, 26 Drawing Sheets

(51) Int. Cl.

| | |
|---|---|
| ***H01Q 7/00*** | (2006.01) |
| ***H01Q 1/24*** | (2006.01) |
| *H01Q 1/22* | (2006.01) |

(56) References Cited

FOREIGN PATENT DOCUMENTS

| | | | |
|---|---|---|---|
| KR | 10-2010-0135294 | A | 12/2010 |
| KR | 10-2011-0025995 | A | 3/2011 |
| KR | 10-2015-0020006 | A | 2/2015 |

* cited by examiner

| MATERIAL OF COVER | ANTENNA MODULE | Communication distance [mm] | | | | EMVco | | | |
|---|---|---|---|---|---|---|---|---|---|
| | | C/E Mode (VIVOpay) | Reader Mode | | | Load Modulation Type A [mV] | | | |
| | | | 1k | topaz | UL | 0, 0, 0 | 1, 0, 0 | 2, 0, 0 | 3, 0, 0 |
| NON-METAL | RELATED ART | 47 | 45 | 42 | 42 | 35.5 | 19.3 | 17.6 | 9.5 |
| | PRESENT INVENTION | 35 | 24 | 22 | 21 | 25.5 | 15.8 | 8.4 | 3.5 |
| METAL | RELATED ART | X | X | X | X | X | X | X | X |
| | PRESENT INVENTION | 35 | 27 | 24 | 24 | 22.5 | 11.2 | 8.5 | 4.1 |

FIG. 13

| ANTENNA MODULE | ANGLE | Communication distance [mm] | | | | EMVco | | | |
|---|---|---|---|---|---|---|---|---|---|
| | | C/E Mode (VIVOpay) | Reader Mode | | | Load Modulation Type A [mV] | | | |
| | | | 1k | topaz | UL | 0, 0, 0 | 1, 0, 0 | 2, 0, 0 | 3, 0, 0 |
| RELATED ART | 0°, 45°, 90° | X | X | X | X | X | X | X | X |
| PRESENT INVENTION | 0° | 35 | 27 | 24 | 24 | 22.5 | 11.2 | 8.5 | 4.1 |
| | 45° | 37 | 28 | 26 | 25 | 23.5 | 11.8 | 8.9 | 4.5 |
| | 90° | 39 | 30 | 28 | 26 | 24.5 | 12.5 | 9.1 | 5.1 |

FIG. 14

| ANGLE | INTERVAL BETWEEN SHORT SIDE OF METAL COVER AND ANTENNA MODULE (X-AXIS) | Communication distance [mm] | | | | EMVco | | | |
|---|---|---|---|---|---|---|---|---|---|
| | | C/E Mode (VIVOpay) | Reader Mode | | | Load Modulation Type A [mV] | | | |
| | | | 1k | topaz | UL | 0, 0, 0 | 1, 0, 0 | 2, 0, 0 | 3, 0, 0 |
| 0° | 0mm | 35 | 27 | 24 | 24 | 22.5 | 11.2 | 8.5 | 4.1 |
| | 5mm | 25 | 18 | 17 | 15 | 15.6 | 9.2 | 5.5 | 2.5 |
| | 10mm | 15 | 10 | 8 | 5 | 9.8 | 5.3 | X | X |

FIG. 20

| INTERVAL BETWEEN SHORT SIDE OF METAL COVER AND ANTENNA MODULE (X-AXIS) | INTERVAL BETWEEN SHORT SIDE OF SUPPORT BOARD AND ANTENNA MODULE(d) | Communication distance [mm] | | | | EMVco | | | |
|---|---|---|---|---|---|---|---|---|---|
| | | C/E Mode (VIVOpay) | Reader Mode | | | Load Modulation Type A [mV] | | | |
| | | | 1k | topaz | UL | 0, 0, 0 | 1, 0, 0 | 2, 0, 0 | 3, 0, 0 |
| 0mm | -15mm | 42 | 40 | 38 | 35 | 32.5 | 17.3 | 15.6 | 7.5 |
| | -10mm | 38 | 40 | 38 | 35 | 31.9 | 17.1 | 15.1 | 7.3 |
| | -5mm | 36 | 30 | 27 | 25 | 25.5 | 13.2 | 7.7 | 4.3 |
| | 0mm | 35 | 27 | 24 | 24 | 22.5 | 11.2 | 8.5 | 4.1 |
| | +5mm | 37 | 32 | 28 | 25 | 25.5 | 13.3 | 7.9 | 4.5 |
| | +10mm | 39 | 37 | 34 | 30 | 28.5 | 15.4 | 8.2 | 5.5 |
| | +15mm | 40 | 40 | 35 | 31 | 30.5 | 17.3 | 8.9 | 6.1 |

FIG. 24

| INTERVAL BETWEEN SHORT SIDE OF METAL COVER AND ANTENNA MODULE (X-AXIS) | INTERVAL BETWEEN SHORT SIDE OF SUPPORT BOARD AND ANTENNA MODULE(d) | PERFORMANCE TEST DIRECTION | Communication distance [mm] | | | | EMVco | | | |
|---|---|---|---|---|---|---|---|---|---|---|
| | | | C/E Mode (VIVOpay) | Reader Mode | | | Load Modulation Type A [mV] | | | |
| | | | | 1k | topaz | UL | 0, 0, 0 | 1, 0, 0 | 2, 0, 0 | 3, 0, 0 |
| 0mm | 0mm | METAL COVER DIRECTION | 35 | 27 | 24 | 24 | 22.5 | 11.2 | 8.5 | 4.1 |
| | | MAIN BODY DIRECTION | 35 | 27 | 24 | 24 | 22.4 | 11.1 | 8.6 | 4.1 |
| | +5mm | METAL COVER DIRECTION | 37 | 32 | 28 | 25 | 25.5 | 13.3 | 7.9 | 4.5 |
| | | MAIN BODY DIRECTION | 25 | 18 | 17 | 15 | 15.6 | 9.2 | 5.5 | 2.5 |
| | +10mm | METAL COVER DIRECTION | 39 | 37 | 34 | 30 | 28.5 | 15.4 | 8.2 | 5.5 |
| | | MAIN BODY DIRECTION | 15 | 15 | 11 | 8 | 12.8 | 7.3 | 3.5 | X |
| | +15mm | METAL COVER DIRECTION | 40 | 40 | 35 | 31 | 30.5 | 17.3 | 8.9 | 6.1 |
| | | MAIN BODY DIRECTION | X | X | X | X | X | X | X | X |

FIG. 25

| INTERVAL BETWEEN SHORT SIDE OF FIRST COVER AND ANTENNA MODULE (X-AXIS) | INTERVAL BETWEEN SHORT SIDE OF SUPPORT BOARD AND ANTENNA MODULE(d) | MATERIAL OF SECOND COVER | Communication distance [mm] | | | | EMVco | | | |
|---|---|---|---|---|---|---|---|---|---|---|
| | | | C/E Mode (VIVOpay) | Reader Mode | | | Load Modulation Type A [mV] | | | |
| | | | | 1k | topaz | UL | 0, 0, 0 | 1, 0, 0 | 2, 0, 0 | 3, 0, 0 |
| 0mm | +10mm | NON-METAL | 39 | 37 | 34 | 30 | 28.5 | 15.4 | 8.2 | 5.5 |
| | | METAL | 39 | 36 | 34 | 30 | 27.8 | 15.2 | 7.9 | 5.4 |
| +10mm | 0mm | NON-METAL | 48 | 40 | 37 | 31 | 32.1 | 17.5 | 9.2 | 6.3 |
| | | METAL | 47 | 39 | 36 | 30 | 32.5 | 17.3 | 8.9 | 6.1 |

FIG. 30

ANTENNA MODULE AND PORTABLE DEVICE HAVING SAME

CROSS-REFERENCE TO THE RELATED APPLICATIONS

This application is a National Stage of International Application No. PCT/KR2016/002417, filed Mar. 10, 2016, which claims priority from Korean Patent Application Nos. 10-2015-0033405 filed on Mar. 10, 2015 and 10-2016-0015179 filed on Feb. 5, 2016 in the Korean Intellectual Property Office, the disclosure of which are incorporated herein by reference in their entirety.

TECHNICAL FIELD

The present invention relates to a near field communication (NFC) antenna module, and more particularly, to an antenna module embedded in a portable device and performing near field communication or electronic payment and a portable device having the same.

BACKGROUND ART

In accordance with development of near field communication technology, recently released portable devices provide a function of performing data transmission and reception using near field communication. Accordingly, an antenna module for near field communication and an antenna module for electronic payment are mounted in the portable device. As the antenna module used for near field communication, a near field communication (NFC) antenna module is used. The NFC antenna module is a non-contact type near field wireless communication module using a frequency band of about 13.56 MHz as one of electronic tags (RFID) and transmits data between devices at a distance of about 10 cm. The NFC is extensively used for transmission of product information in a supermarket or a general market or travel information for visitors, traffic, admission control locking device, or the like, in addition to payment.

Further, as recently released portable devices require a function relating to electronic payment using a portable device such as Apple pay, Samsung Pay, or the like, an antenna for electronic payment is mounted. For example, since Samsung Pay performs electronic payment using a magnetic secure transmission scheme, in a portable device supporting Samsung Pay, a magnetic secure transmission (MST) antenna is mounted.

Further, application of a cover made of a metal material (hereinafter, referred to as metal cover) to the recently released portable devices is on a rising trend. If a back cover 10 of a portable device is made of a metal material as illustrated in FIG. 1, performance of an antenna module 20 (that is, an NFC antenna module and MST antenna module) connected to a circuit board 30 of the portable device is difficult to be implemented. That is, if the back cover 10 of the portable device is made of a metal material, since current flows in the back cover 10 in an opposite direction to the antenna module 20 to perform a shielding function of attenuating a signal of the antenna module 20, formation of a radiation field is blocked, such that an antenna performance may not be implemented.

Thus, various researches for implementing performance of an antenna module mounted in a portable device have been conducted. For example, as illustrated in FIG. 2, according to the related art, in a portable device 40 using a back cover 10 made of a metal material, a slit 50 or an opening (not illustrated) is formed in the metal cover to implement performance of the antenna module 20, and an antenna module 20 is mounted so as to partially overlap the slit 50 or the opening. Accordingly, the performance of the antenna module 20 can be implemented through coupling effect between the antenna module 20 and the back cover 10 at the slit 50 or the opening.

However, if the slit 50 or the opening is formed to implement performance of the antenna module 20, a manufacturing process of the portable device 40 becomes complicated, such that manufacturing costs are increased, and the slit 50 or the opening needs to be reflected to an appearance design.

Meanwhile, as illustrated in FIG. 3, as user environment has become diverse recently, the portable device 40 requires a structure capable of performing near field communication and electronic payment in a plane direction (i.e. a back surface of the portable device) and a vertical direction (i.e. a side surface of the portable device).

However, as illustrated in FIG. 4, since a radiation pattern 24 is formed in the existing antenna module 20 (that is, NFC antenna module and MST antenna module) by winding a coil on an upper surface of a shielding sheet 22, it is difficult to implement the antenna performance in the vertical direction (i.e. a side surface direction of the portable device).

DISCLOSURE

Technical Problem

The present invention is suggested to solve the problems according to the related art as described above, and an object of the present invention is to provide an antenna module in which a radiation pattern is alternately formed on an upper surface and a lower surface of a shielding sheet to be wound on the shielding sheet in a vertical direction, and a portable device having the same.

Technical Solution

According to an embodiment of the present invention, an antenna module comprises a shielding sheet and a radiation pattern alternately formed on an upper surface and a lower surface of the shielding sheet to be wound in a vertical direction of the shielding sheet.

The radiation pattern may comprise a plurality of first coils formed to be spaced apart from each other on one surface of the shielding sheet, a plurality of second coils formed to be spaced apart from each other on one side surface of the shielding sheet and each having one end connected to one of the plurality of first coils, a plurality of third coils formed to be spaced apart from each other on the other surface opposite to the one surface of the shielding sheet and each having one end connected to one of the plurality of second coils, and a plurality of fourth coils formed to be spaced apart from each other on the other side surface opposite to the one side surface of the shielding sheet and each having one end connected to one of the plurality of third coils and the other end connected to one of the plurality of first coils.

At least one of the plurality of first coils that is adjacent to a side surface of the shielding sheet may have one end connected to one of the plurality of second coils and the other end connected to a terminal portion.

At least one of the plurality of third coils that is adjacent to a side surface of the shielding sheet may have one end connected to one of the plurality of second coils and the other end connected to a terminal portion.

According to another embodiment of the present invention, a portable device having an antenna module comprises a back cover formed of a metal material, and the antenna module having a radiation pattern formed along a short side direction of the back cover, and mounted to be biased from the center of the back cover to a short side of the back cover.

The portable device may further comprise a support board, in which the antenna module may be interposed between the back cover and the support board. One side of the antenna module may be collinearly disposed with a short side of the back cover and a short side of the support board, or one side of the antenna module may be collinearly disposed with a short side of the back cover, and a short side of the support board may be disposed to be spaced apart from one side of the antenna module and the short side of the back cover.

The portable device may further comprise a support board having a short side disposed to be spaced apart from the short side of the back cover, in which the antenna module may be mounted so that one side thereof is collinearly disposed with the short side of the back cover and the other side thereof is collinearly disposed with the short side of the support board.

The back cover may comprise a first cover formed of a metal material, and a second cover formed to be spaced apart from the first cover. The back cover may further comprise a gap formed between the first cover and the second cover and filled with a non-metallic material.

The antenna module may be mounted to be biased to one side of the first cover adjacent to the second cover and form a radiation field at a gap between the first cover and the second cover.

The antenna module may be mounted to be biased to one side of the second cover opposing to a side of the second cover adjacent to the first cover and form a radiation field at one side and the other side of the second cover.

Advantageous Effects

According to the present invention, in the antenna module, the radiation pattern is alternately formed on the upper surface and the lower surface of the shielding sheet to be wound on the shielding sheet in the vertical direction, thereby implementing the antenna performance meeting the standard in the portable device using the metal cover, and implementing the antenna performance equivalent or more to the existing antenna module mounted in a portable device using a cover made of a material other than a metal material.

Further, in the antenna module, the radiation pattern is alternately formed on the upper surface and the lower surface of the shielding sheet to be wound on the shielding sheet in the vertical direction, thereby implementing the antenna performance in the vertical direction (that is, the side surface of the portable device) in addition to the plane direction (that is, the back surface of the portable device).

Further, in the antenna module, the radiation pattern is alternately formed on the upper surface and the lower surface of the shielding sheet to be wound on the shielding sheet in the vertical direction, thereby minimizing deviation of the antenna performance according to an angle.

According to the present invention, the portable device has the antenna module in which the radiation pattern is alternately formed on the upper surface and the lower surface of the shielding sheet to be wound on the shielding sheet in the vertical direction mounted therein, such that the equivalent level of antenna characteristic can be implemented even in the case in which the material (that is, metal material and non-metallic material) of the back cover is changed.

Further, the portable device implements the equivalent level of antenna characteristic regardless of the material of the cover by using the antenna module, thereby minimizing restriction on design for implementing the antenna performance to maximize mass-productivity of the portable device.

Further, the portable device has the antenna module in which the radiation pattern is alternately formed on the upper surface and the lower surface of the shielding sheet to be wound on the shielding sheet in the vertical direction mounted therein, thereby implementing the antenna performance at various angles such as a front surface, a back surface, side surfaces, and the like of the portable device to maximize convenience of a user at the time of performing near field communication and electronic payment.

DESCRIPTION OF DRAWINGS

FIGS. 7 to 14 are views for describing antenna characteristics of an antenna module according to an embodiment of the present invention.

FIGS. 15 to 30 are views for describing a portable device having an antenna module according to an embodiment of the present invention.

MODE FOR INVENTION

Figure 1:
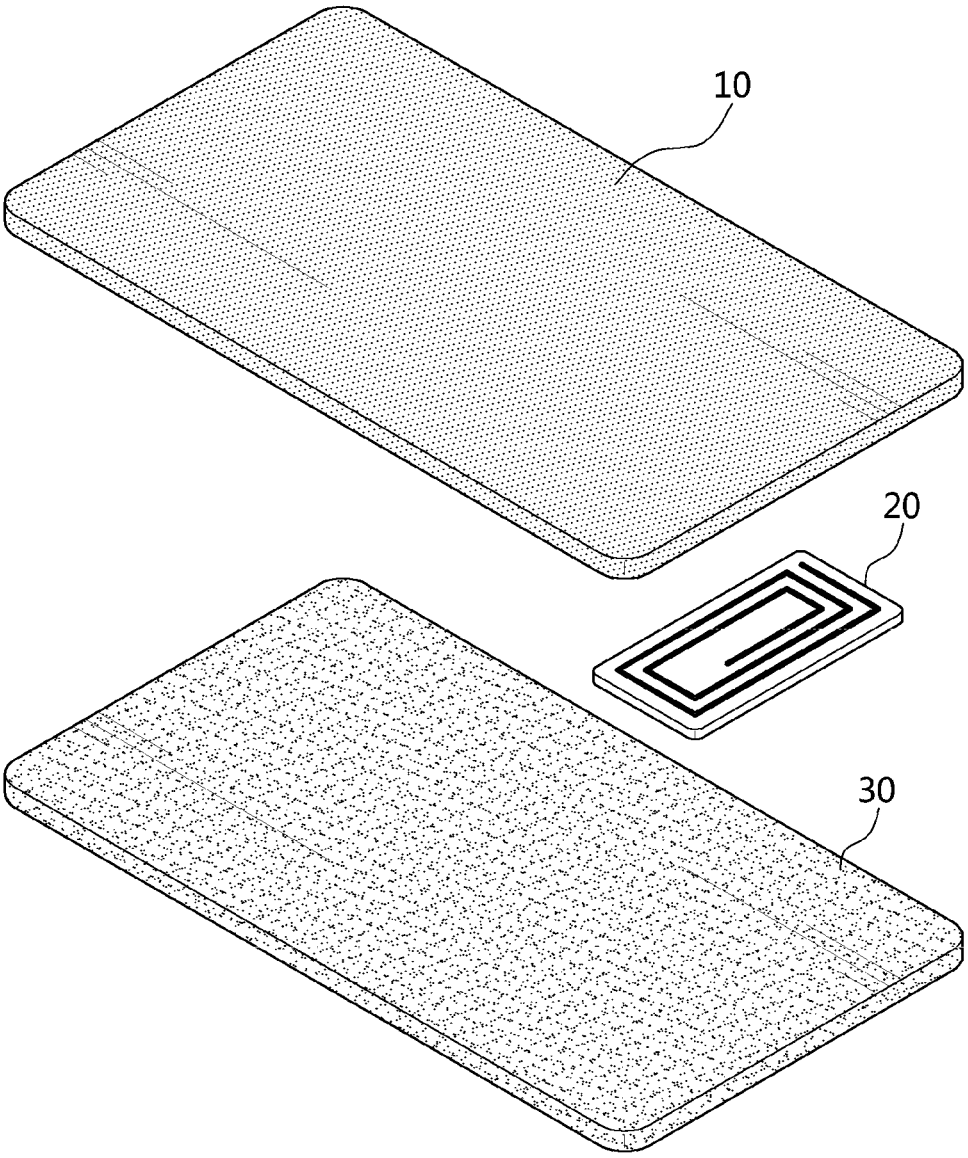
FIG. 1 Prior Art
FIGS. 1 to 4 are views for describing an antenna module according to a related art.
Figure 2:
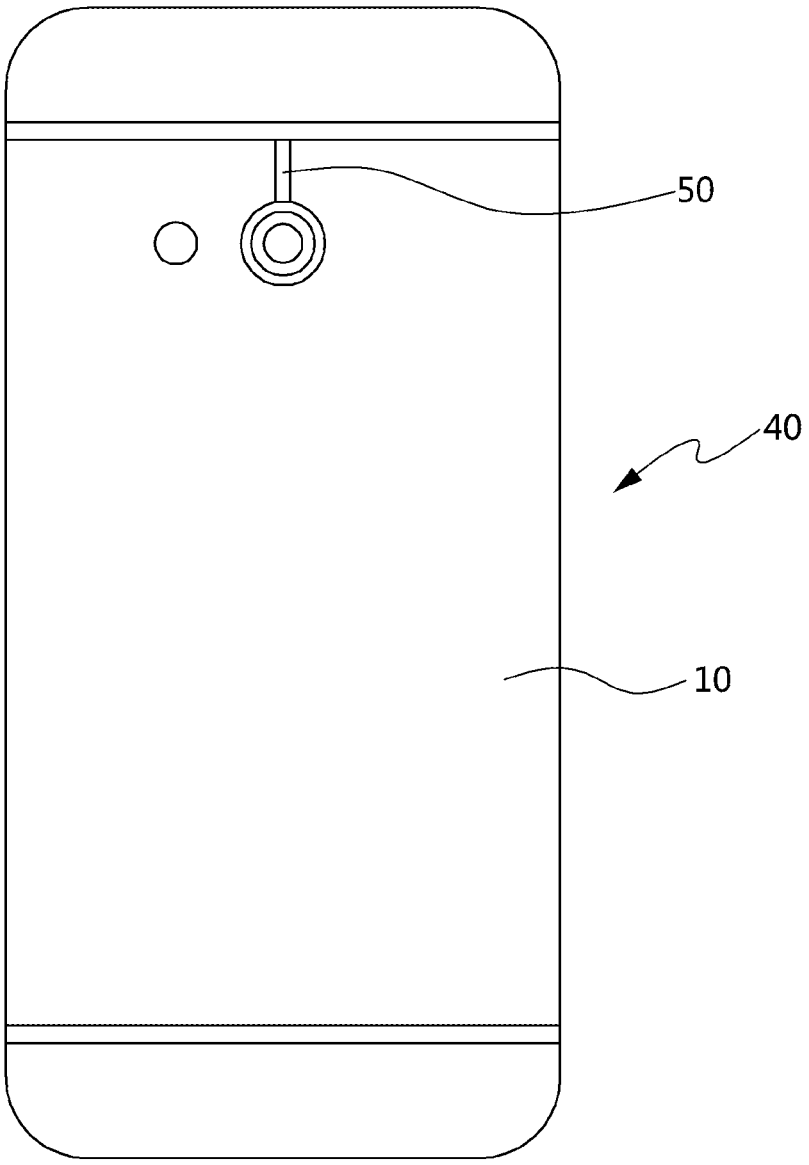
FIG. 2 Prior Art
Figure 3:
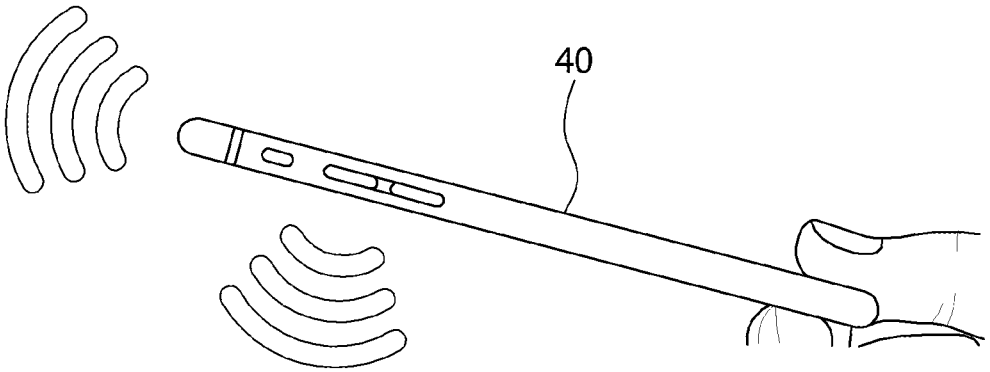
FIG. 3 Prior Art
Figure 4:
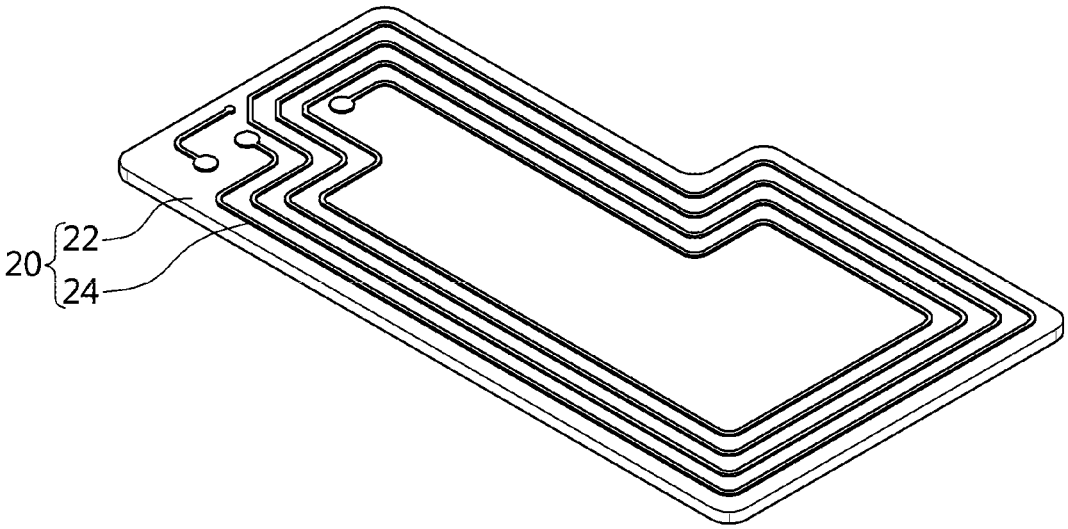
FIG. 4 Prior Art

Hereinafter, most preferred embodiments of the present invention will be described in detail with reference to the accompanying drawings so that those skilled in the art to which the present invention pertains may easily practice the technical idea of the present invention. First, it is to be noted that in adding reference numerals to elements of each drawing, like reference numerals refer to like elements even though like elements are shown in different drawings. Further, in describing embodiments of the present invention, when it is determined that detailed description of known functions or configuration may obscure the gist of the present invention, the detailed description will be omitted.

Figure 5:
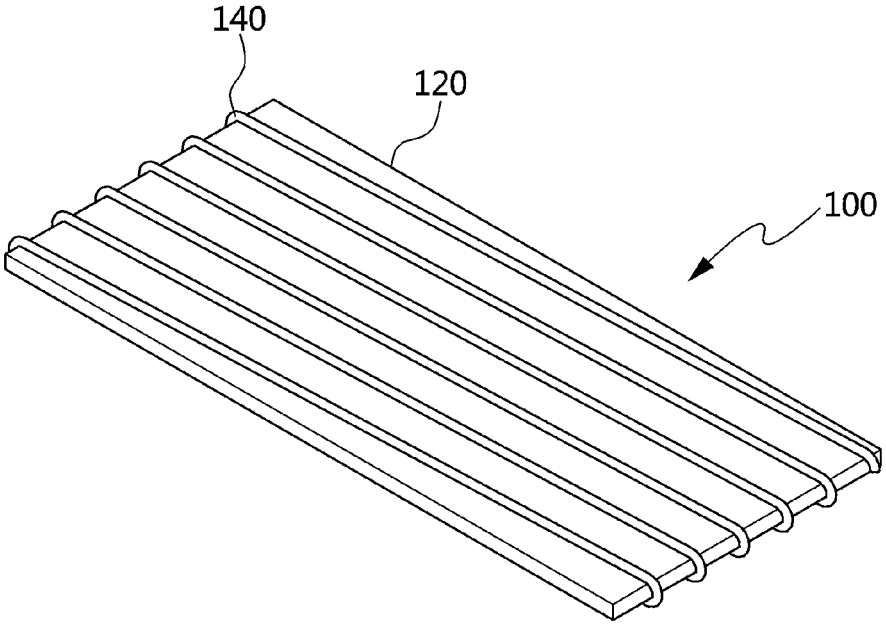
FIGS. 5 and 6 are views for describing an antenna module according to an embodiment of the present invention.
Figure 6:
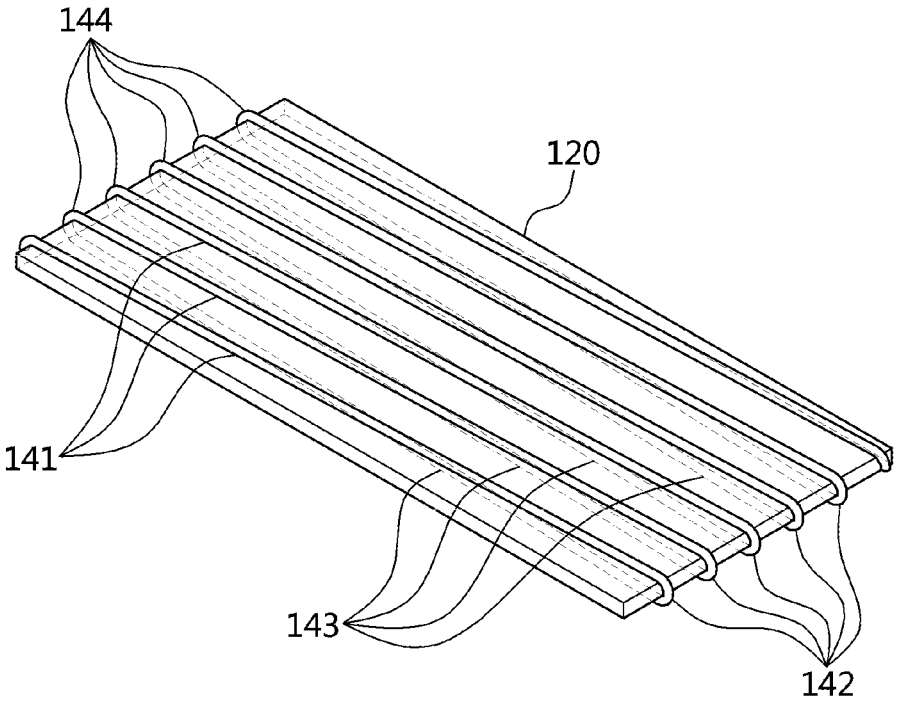

Hereinafter, an antenna module according to an embodiment of the present invention will be described in detail with reference to the accompanying drawings. FIGS. 5 and 6 are views for describing an antenna module according to an embodiment of the present invention.

As shown in FIG. 5, an antenna module 100 is configured to include a shielding sheet 120 and a radiation pattern 140.

The shielding sheet 120 is configured as a sheet made of a shielding material with permeability such as a ferrite sheet, a polymer sheet, a metal sheet, or the like. Here, the shielding sheet 120 may also be configured by stacking a plurality of sheets formed of a single material, or by stacking a plurality of sheets each formed of different materials.

The radiation pattern 140 is formed in a vertical direction of the shielding sheet 120. That is, the radiation pattern 140 is alternately formed on an upper surface and a lower surface of the shielding sheet 120 to be formed in the vertical direction of the shielding sheet 120. At this time, in the radiation pattern 140, a coil is wound on any one surface of the upper surface and the lower surface of the shielding sheet 120, and then is wound on the other surface via one side surface of the shielding sheet 120. After the radiation pattern 140 is formed on the other surface, the coil is wound on one surface of the shielding sheet 120 via the other side surface.

Accordingly, the radiation pattern 140 is formed in the vertical direction of the shielding sheet 120 by repeatedly winding the coil alternately on the upper surface and the lower surface of the shielding sheet 120. At this time, both ends of the radiation pattern 140 are connected to terminal portions (not illustrated) and the coils formed on the same surface of the shielding sheet 120 are formed while being spaced apart from each other by a predetermined interval. Here, the radiation pattern 140 is illustrated as being configured of a wire coil in FIG. 5, but may also be formed in various types such as an FPCB type.

To this end, as illustrated in FIG. 6, the radiation pattern 140 is configured of first coils 141 to fourth coils 144.

The first coils 141 are formed on one surface (for example, upper surface) of the shielding sheet 120. One of the first coils 141 that is adjacent to one side surface of the shielding sheet 120 has one end connected to one of the second coils 142 and the other end connected to the terminal portion (not illustrated). Each of the other first coils 141 has one end connected to one of the second coils 142 and the other end connected to one of the fourth coils 144. At this time, the first coils 141 are spaced apart from each other and formed to be parallel to each other.

The second coils 142 are formed on one side surface of the shielding sheet 120. Each of the second coils 142 has one end connected to one end of one of the first coils 141 and the other end connected to one of the third coils 143. At this time, the second coils 142 are spaced apart from each other and formed to be parallel to each other.

Third coils 143 are formed on the other surface (for example, lower surface) of the shielding sheet 120. Each of the third coils 143 has one end connected to one of the second coils 142 and the other end connected to one of the fourth coils 144. One of the third coils 143 that is adjacent to the other side surface of the shielding sheet 120 has one end connected to one of the second coils 142 and the other end connected to the terminal portion (not illustrated). The third coils 143 are spaced apart from each other and formed to be parallel to each other.

The fourth coils 144 are formed on the other side surface (that is, a side surface opposite to the side surface on which the third coils 143 are formed) of the shielding sheet 120. Each of the fourth coils 144 has one end connected to one end of one of the third coils 143 and the other end connected to one of the first coils 141. At this time, the fourth coils 144 are spaced apart from each other and formed to be parallel to each other.

Hereinafter, antenna characteristics of the antenna module 100 according to the embodiment of the present invention will be described in detail with reference to the accompanying drawings. FIGS. 7 to 14 are views for describing antenna characteristics of the antenna module 100 according to the embodiment of the present invention.

Figure 7:
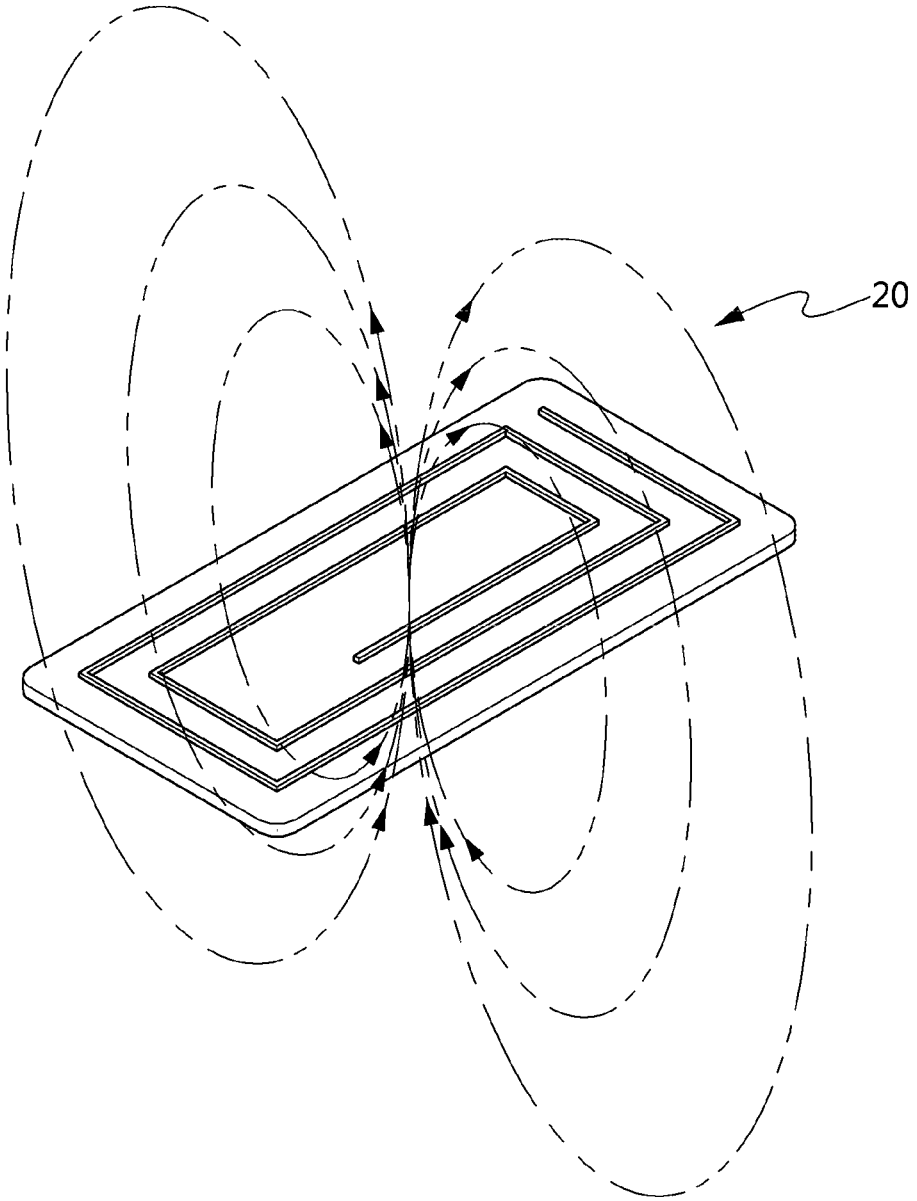

As illustrated in FIG. 7, in an existing antenna module 20, a radiation pattern 24 is formed by winding a coil on an upper surface of a shielding sheet 22, thus a radiation field in a form in which a magnetic field is output from the upper surface of the shielding sheet 22 and input to a lower surface of the shielding sheet 22 is formed. That is, the existing antenna module 20 forms the radiation field in a vertical direction of the shielding sheet 22.

Accordingly, if the existing antenna module 20 is mounted in the portable device using a back cover 10 made of a metal material in which a slit or a slot is not formed, the radiation field is shielded by the back cover 10. That is, the back cover 10 made of a metal material serves as a shielding member shielding a magnetic field of the antenna module 20 by flowing a reverse current (that is, a current flowing in a direction opposite to the antenna module 20).

Figure 8:
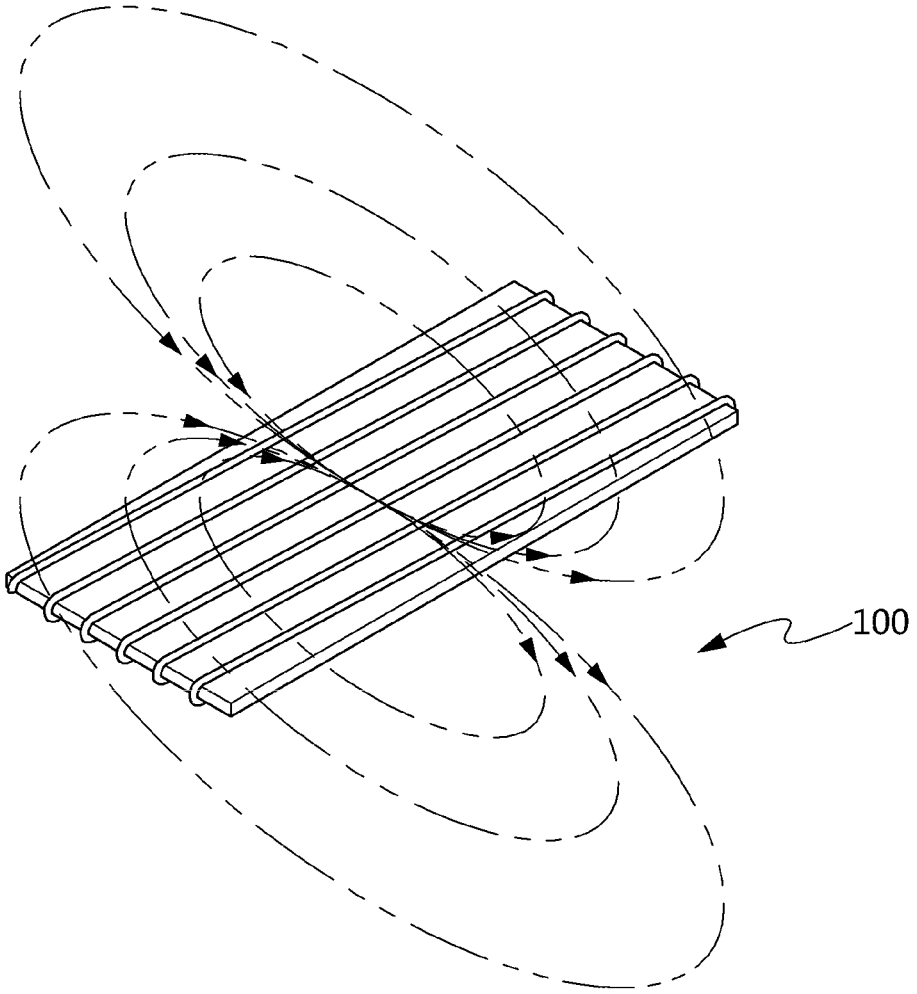

On the contrary, as illustrated in FIG. 8, the antenna module 100 according to the embodiment of the present invention forms a radiation field in a form in which a magnetic field is output from one side surface of the shielding sheet 120 and input to the other side surface. That is, the antenna module 100 forms the radiation field in a horizontal direction of the shielding sheet 120.

Accordingly, the antenna module 100 forms the radiation filed in a side surface direction in the portable device using the back cover 200 made of a metal material in which a slit or a slot is not formed. At this time, in the antenna module 100, the magnetic field is output from one side surface of the portable device, and input to the other side surface, thus the antenna module 100 is not affected by the back cover 200.

Figure 9:
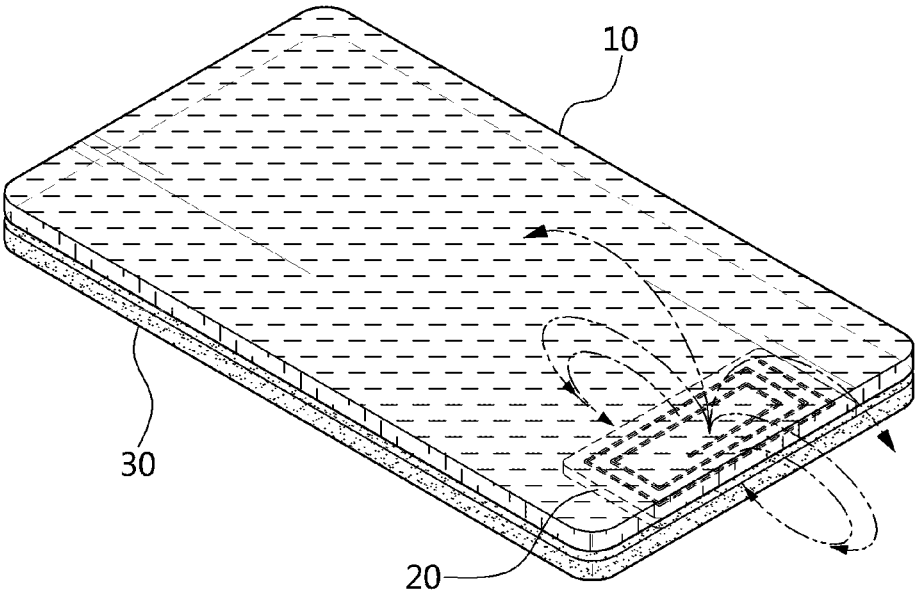

As illustrated in FIG. 9, in the existing antenna module 20, the radiation pattern 24 is wound on one surface of the shielding sheet 22 in a horizontal direction, thus the radiation field is formed in the vertical direction at the back surface of the portable device if the existing antenna module 20 is mounted in a portable device using a back cover 10 made of a non-metallic material. At this time, in the case of the back cover 10 made of a non-metallic material, since the shielding operation is not performed, the radiation field is maintained as it is. Thus, the existing antenna module 20 shows a minimum reference level or more of antenna performance for performing NFC or MST communication.

Figure 10:
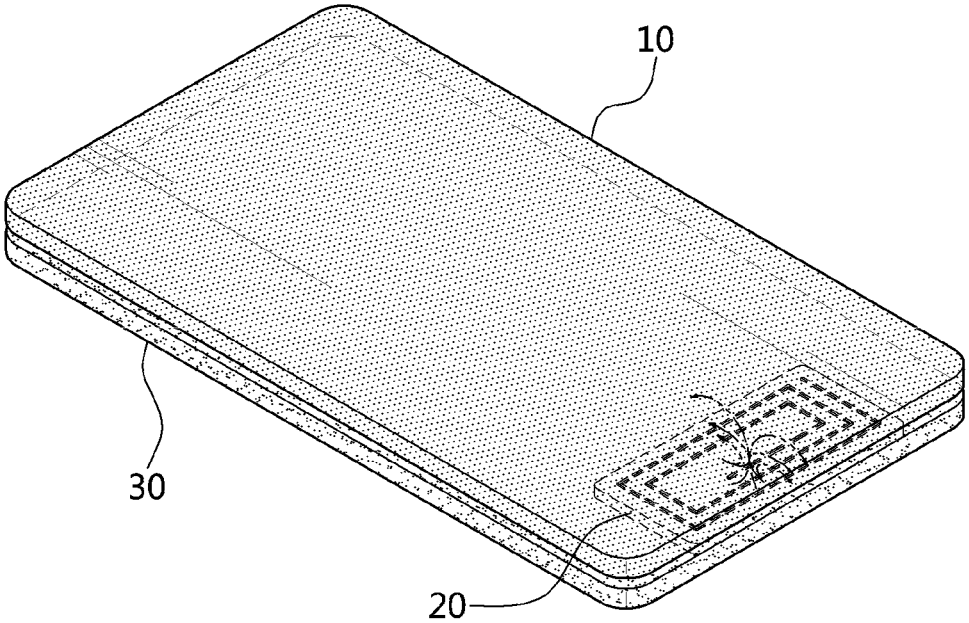

However, as illustrated in FIG. 10, if the existing antenna module 20 is mounted in the portable device using the back cover 10 made of a metal material in which a slit or a slot is not formed, the radiation field is shielded by the back cover 10 serving as a shielding member. At this time, the existing antenna module 20 may not perform the NFC and MST communication since the radiation field may not be formed at the back surface of the portable device by the back cover 10.

Figure 11:
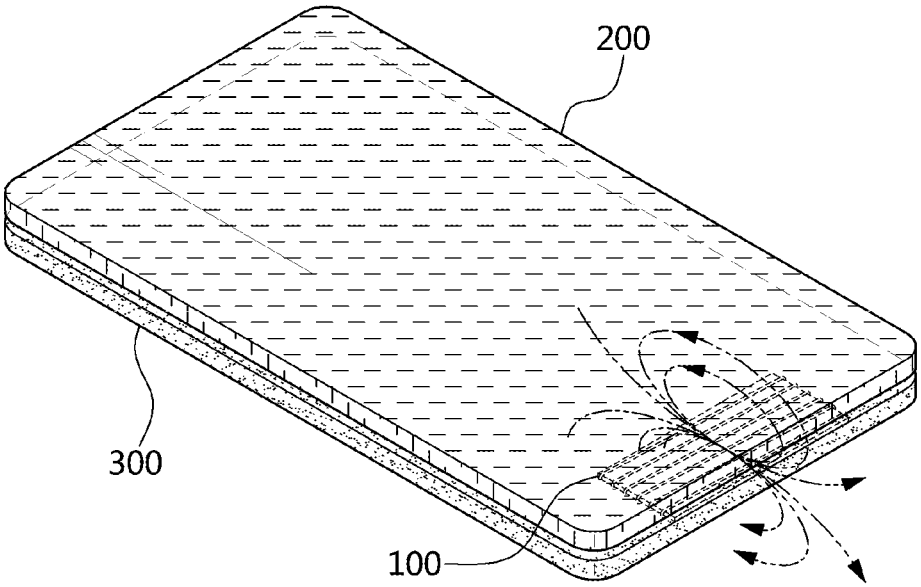

Meanwhile, as illustrated in FIG. 11, in the antenna module 100 according to the embodiment of the present invention, since the radiation pattern 140 is wound in the vertical direction, if the antenna module 100 is mounted on a support board 300 of the portable device using the back cover 200 made of a non-metallic material, the radiation field is formed at the side surface and the back surface of the portable device, and a minimum reference level or more of antenna characteristic for performing the NFC and MST communication is shown.

Figure 12:
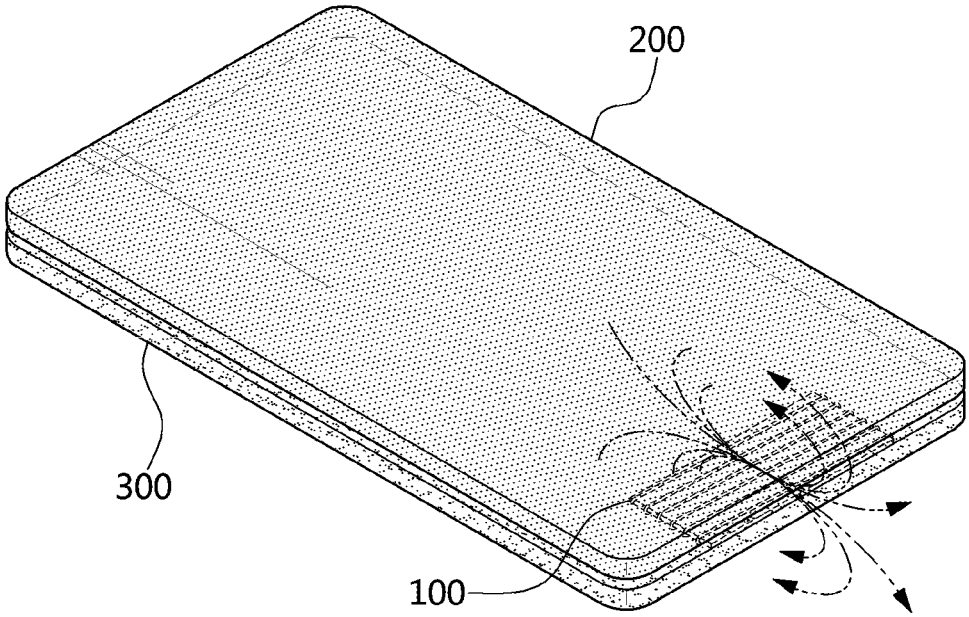

Further, as illustrated in FIG. 12, in the antenna module 100 according to the embodiment of the present invention, the radiation field is formed at the side surface of the portable device and a minimum reference level or more of antenna characteristic for performing the NFC and MST communication is shown even in the case in which the antenna module 100 is mounted in the portable device using the back cover 200 made of a metal material.

For example, as illustrated in FIG. 13, the existing antenna module 20 has the minimum reference level or more of antenna characteristic for NFC only in the case of using the back cover 10 made of a non-metallic material, and the antenna module 100 according to the embodiment of the present invention has the minimum reference level or more of antenna characteristic for NFC in both of the case of using the back cover 200 made of a metal material and the case of using the back cover 200 made of a non-metallic material.

Further, if the existing antenna module 20 is mounted in the portable device using the back cover 10 made of a metal material, the magnetic field is shielded in all directions such as a back surface direction (90°), a diagonal direction (45°) of the back surface, a side surface direction (0°), and the like of the portable device due to shielding by the back cover 10. Accordingly, the minimum reference level or more of antenna performance for NFC and MST communication may not be implemented in all directions of the portable device.

However, in the antenna module 100 according to the embodiment of the present invention, since the radiation pattern 140 is formed in the vertical direction of the shielding sheet 120, the minimum reference level or more of antenna performance for NFC and MST communication may be implemented in all directions such as the back surface direction (90°), the diagonal direction (45°) of the back surface, the side surface direction (0°), and the like of the portable device due to shielding by the back cover 10

For example, as illustrated in FIG. 14, when comparing antenna characteristics of the existing antenna module 20 operated as an NFC antenna and the antenna module 100 according to the embodiment of the present invention, it may be appreciated that the existing antenna module 20 may not implement the minimum reference level or more of antenna performance for NFC in the back surface direction (90°), the diagonal direction (45°) of the back surface, and the side surface direction (0°), whereas the antenna module 100 according to the embodiment of the present invention may implement the minimum reference level or more of antenna performance for NFC in the back surface direction (90°), the diagonal direction (45°) of the back surface, and the side surface direction (0°).

At this time, in the antenna module 100 according to the embodiment of the present invention, the deviation of the antenna performance is not large even though the angle is changed, thus an equivalent level of communication (that is, NFC or MST communication) may be performed at any location.

As described above, in the antenna module 100, the radiation pattern 140 is alternately formed on the upper surface and the lower surface of the shielding sheet 120 to be wound on the shielding sheet 120 in the vertical direction, thereby implementing the antenna performance meeting the standard in the portable device using the back cover 200 made of a metal material, and implementing the antenna performance equivalent or more to the existing antenna module 20 mounted in the portable device using the back cover 10 made of a non-metallic material.

Further, in the antenna module 100, the radiation pattern 140 is alternately formed on the upper surface and the lower surface of the shielding sheet 120 to be wound on the shielding sheet 120 in the vertical direction, thereby implementing the antenna performance in the vertical direction (that is, the side surface of the portable device) in addition to the plane direction (that is, the back surface of the portable device).

Further, in the antenna module 100, the radiation pattern 140 is alternately formed on the upper surface and the lower surface of the shielding sheet 120 to be wound on the shielding sheet 120 in the vertical direction, thereby minimizing deviation of the antenna performance according to an angle.

Hereinafter, a portable device having the antenna module according to the embodiment of the present invention will be described in detail with reference to the accompanying drawings. FIGS. 15 to 30 are views for describing a portable device having the antenna module according to the embodiment of the present invention.

Figure 15:
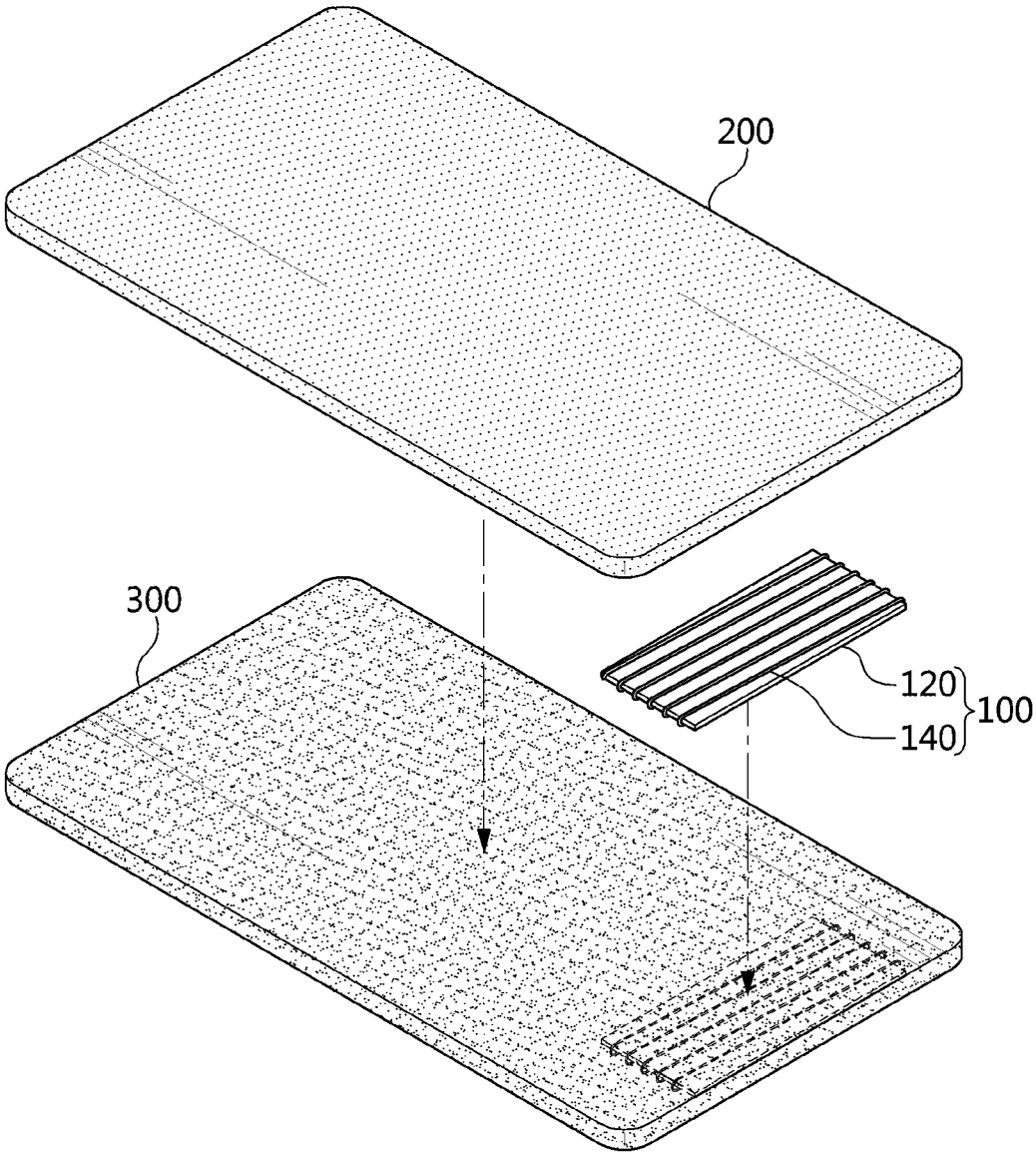

As illustrated in FIG. 15, a portable device is configured to include an antenna module 100, a support board 300, and a back cover 200.

The antenna module 100 is interposed between the support board 300 and the back cover 200. At this time, the antenna module 100 is mounted while being biased from the center of the back cover 200 to one short side.

The antenna module 100 is mounted in the portable device to be operated as an antenna for NFC or an antenna for MST communication. To this end, the antenna module 100 is formed by winding a radiation pattern 140 in a vertical direction of a shielding sheet 120. In the antenna module 100, the radiation pattern 140 is wound in the vertical direction of the shielding sheet 120, and the antenna module 100 is formed in the wound state in a short side direction of the support board 300.

The support board 300 is embedded in the portable device to support the antenna module 100. The support board 300 is configured by a PCB made of a metal material on which a circuit is mounted like a main board of the portable device, a display module such as LCD, and the like.

Figure 16:
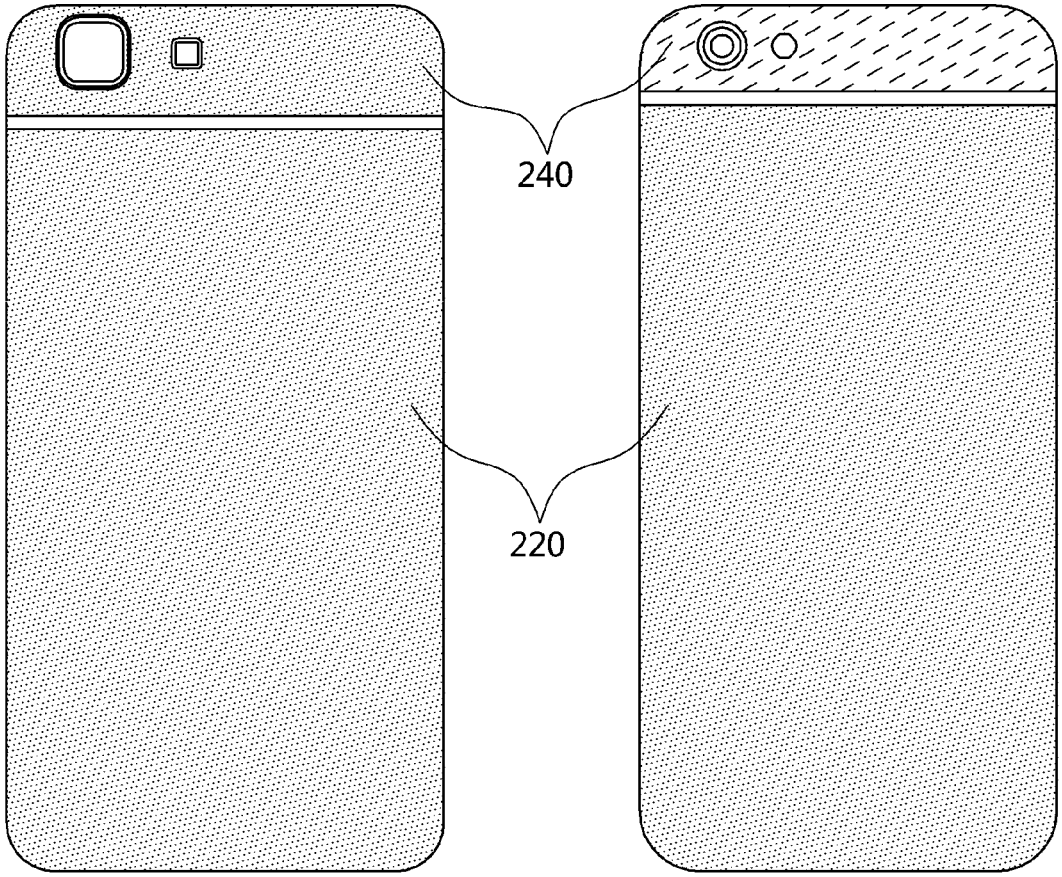

The back cover 200 is formed of a metal material and coupled to a back surface of the portable device. At this time, as illustrated in FIG. 16, in the back cover 200, a first cover 220 and a second cover 240 are separately formed, and a gap 260 may be formed between the first cover 220 and the second cover 240. At this time, the first cover 220 may be formed of a metal material, and the second cover 240 may be made of a metal material or a non-metallic material. The gap 260 may be filled with a non-metallic material.

Here, if the back cover 200 is separately formed as the first cover 220 and the second cover 240, the antenna module 100 is mounted while being biased to one side of the first cover 220 (that is, one side adjacent to the second cover 240), or to one side of the second cover 240 (that is, one side in the one short side direction of the support board 300).

The antenna performance of the portable device may be changed depending on disposition positions of the antenna module 100, the support board 300, and the back cover 200. That is, the antenna performance for NFC or MST communication of the portable device may be changed depending on the disposition positions of the antenna module 100 and the back cover 200, and the disposition positions of the antenna module 100 and the support board 300.

First, the antenna performance of the portable device depending on the disposition positions of the antenna module 100 and the back cover 200 will be compared and described below with reference to FIGS. 17 to 20.

Figure 17:
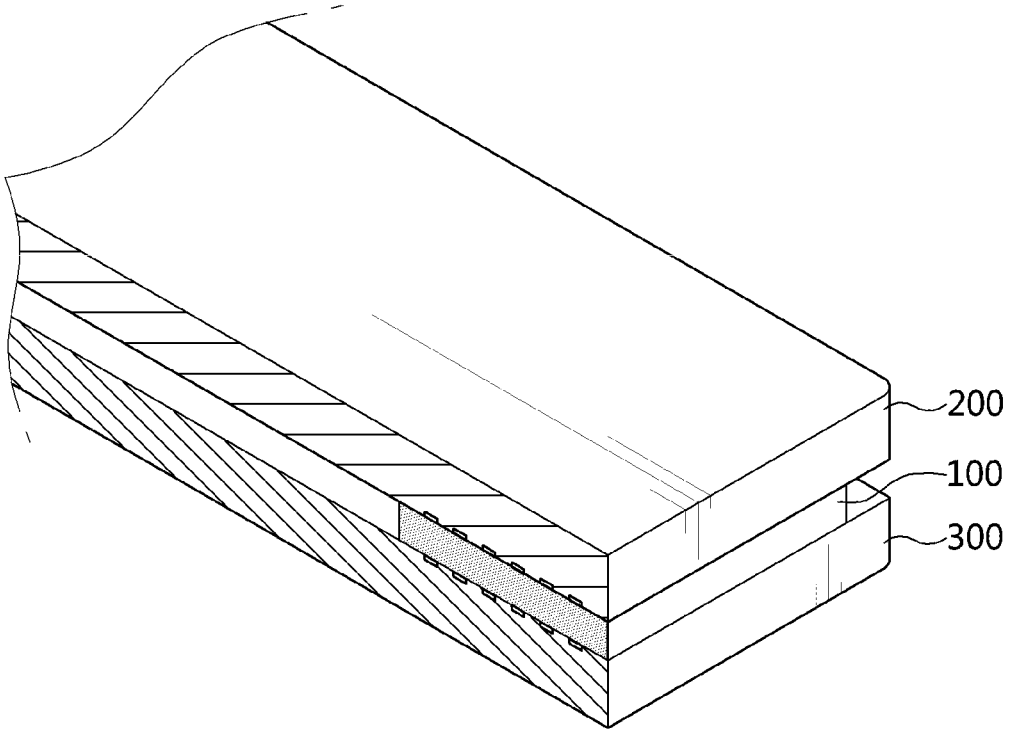
Figure 18:
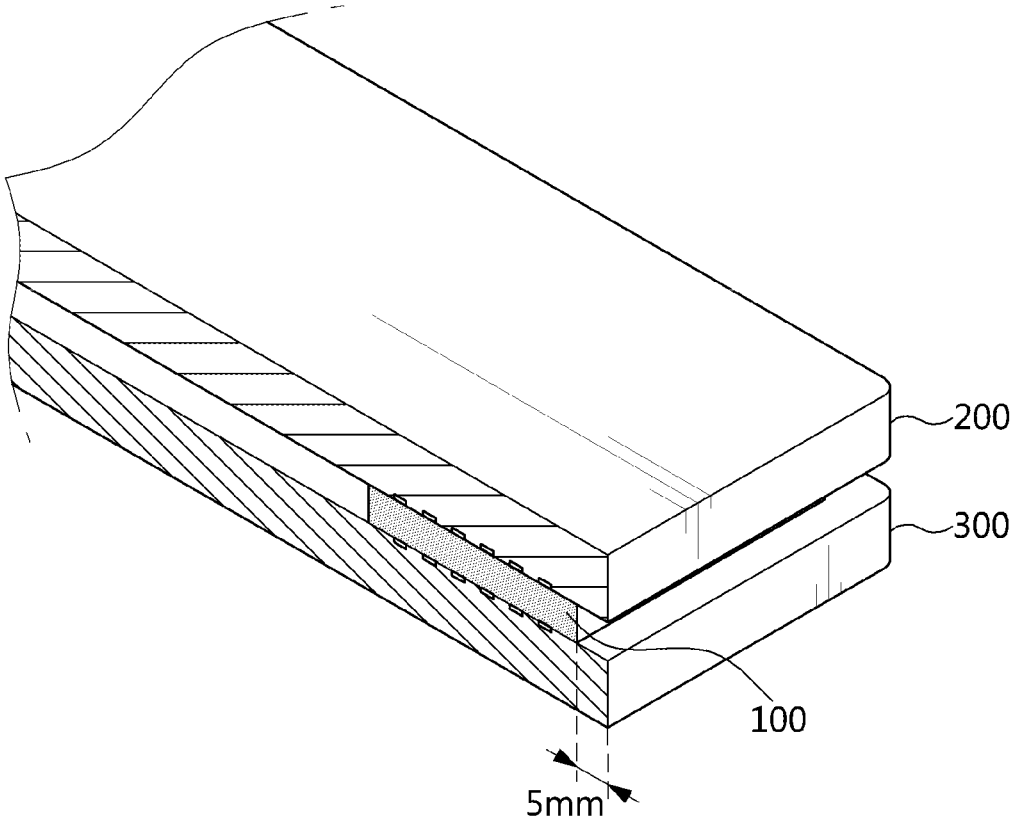
Figure 19:
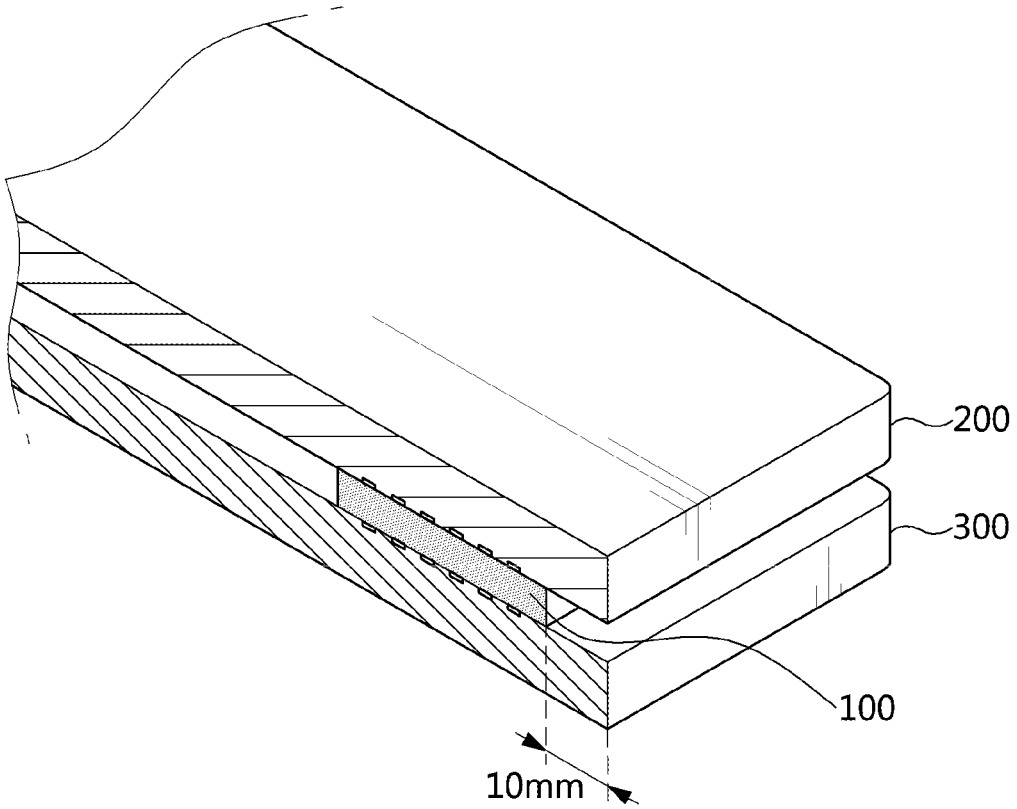
Figure 21:
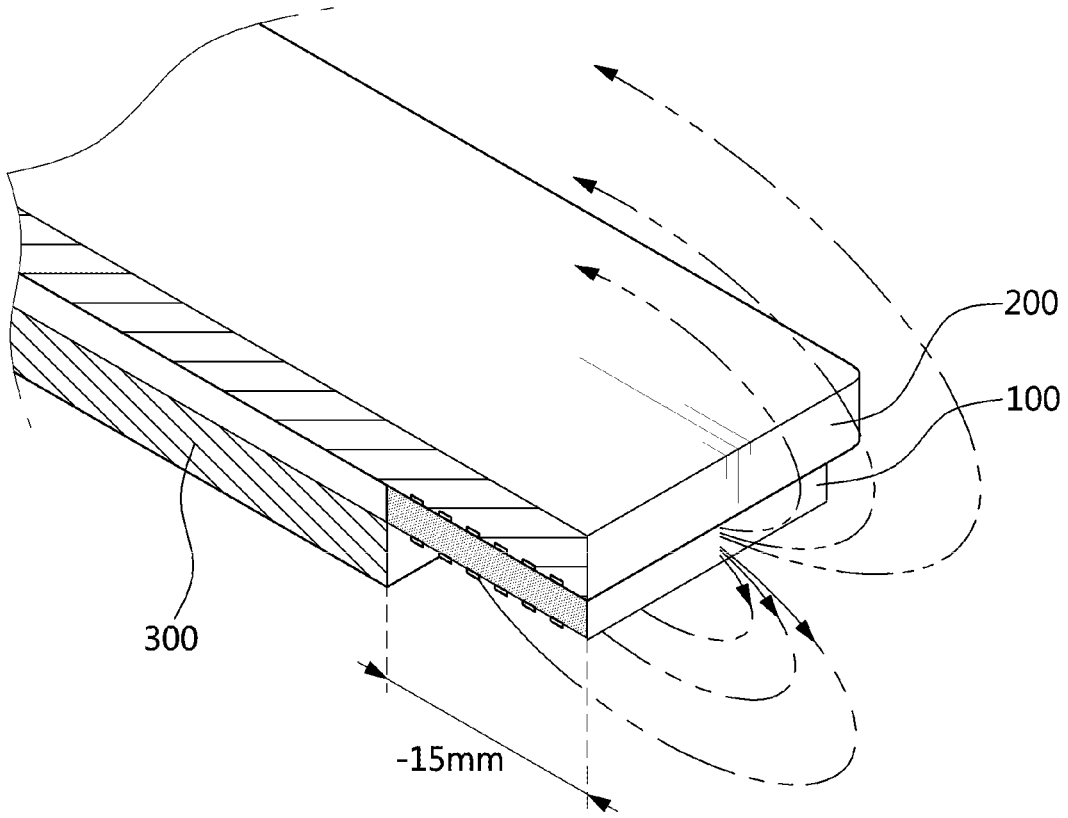
Figure 22:
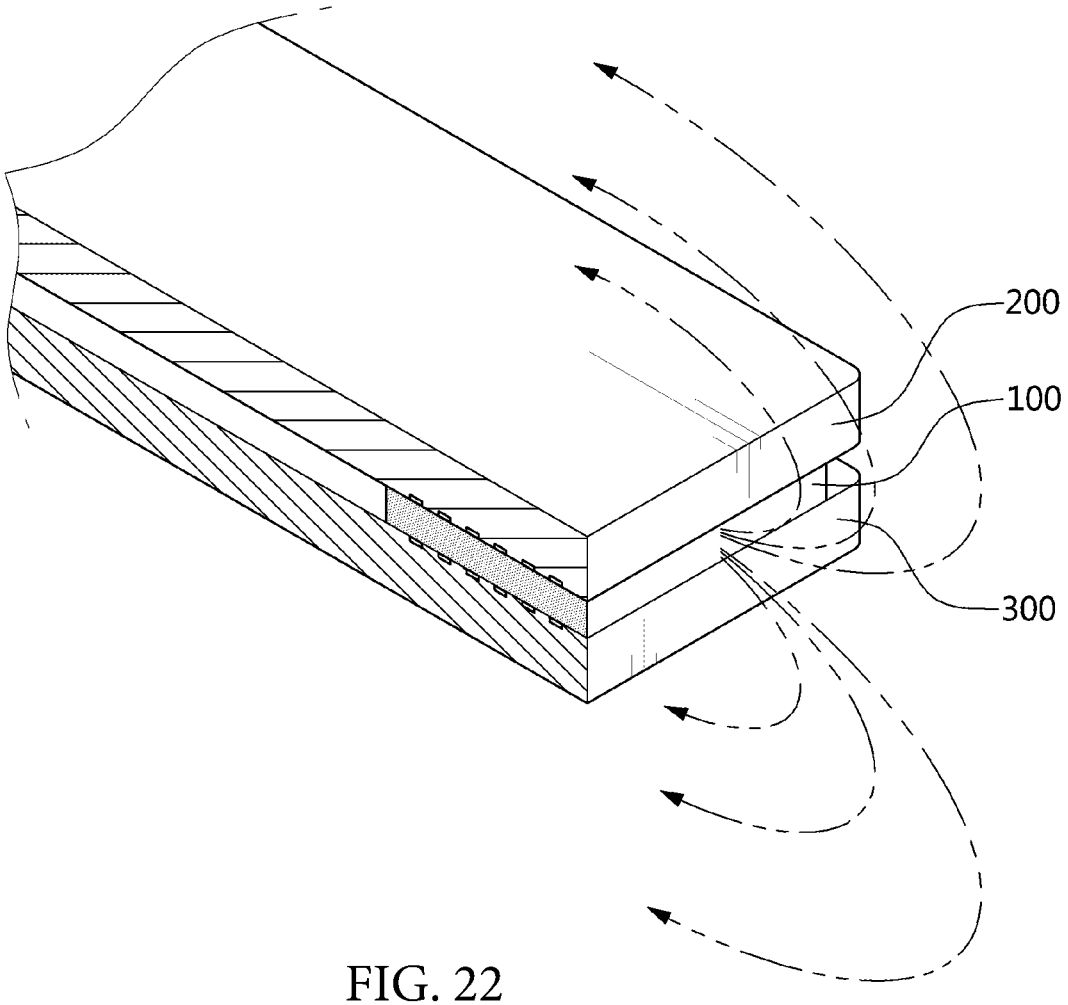
Figure 23:
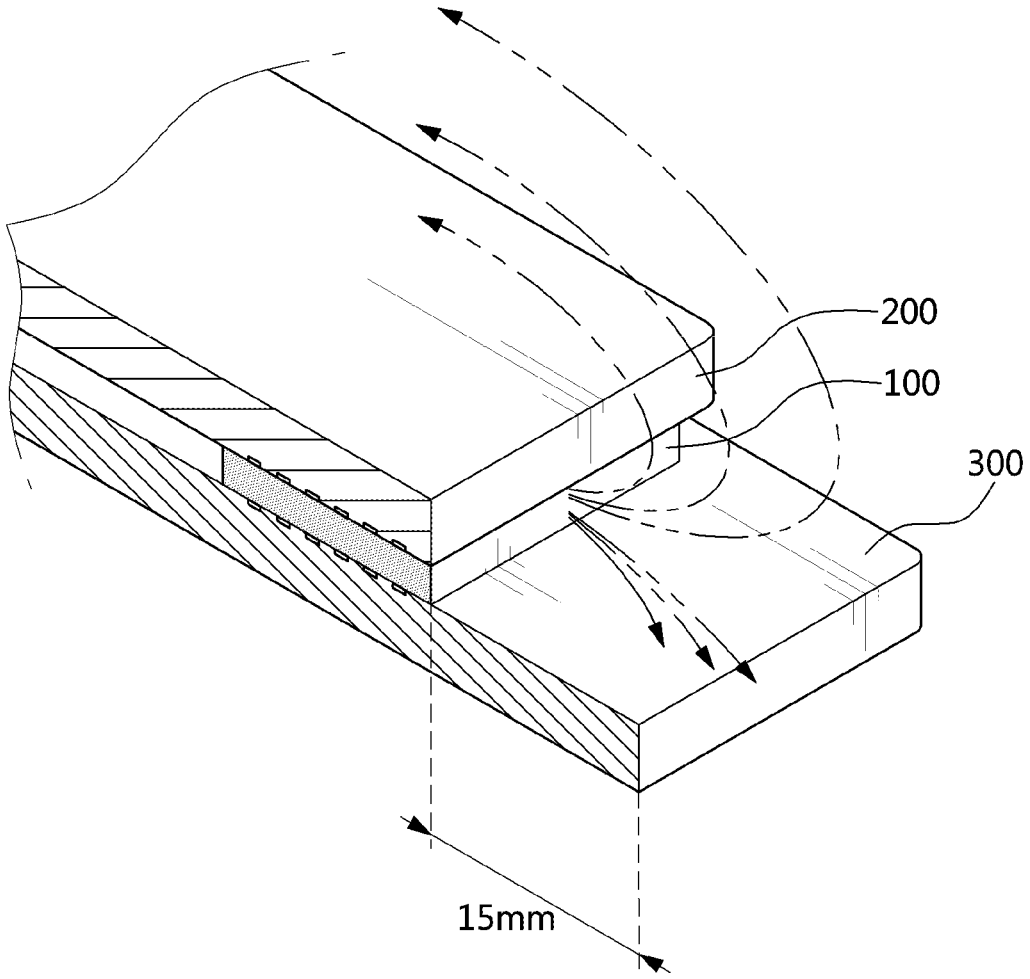

The antenna module 100 is mounted while being biased from the center of the support board 300 to one short side. At this time, FIG. 17 illustrates a first portable device in which the antenna module 100 is disposed collinearly (that is, an interval between the antenna module 100 and the short side of the back cover 200 is 0 mm) with a short side of the back cover 200, FIG. 18 illustrates a second portable device in which the antenna module 100 is disposed to be spaced apart form the short side of the back cover 200 by a first interval (for example, about 5 mm), and FIG. 19 illustrates a third portable device in which the antenna module 100 is disposed to be spaced apart form the short side of the back cover 200 by a second interval (for example, about 10 mm).

As illustrated in FIG. 20, an antenna performance depending on the disposition position of the antenna module 100 operated as the NFC antenna and the back cover 200 was measured, and as a result, it may be appreciated that the first portable device shows the highest antenna performance and the third portable device shows the lowest antenna performance.

That is, the first portable device in which the antenna module 100 is collinearly disposed with the short side of the back cover 200 shows the highest antenna characteristic (that is, NFC antenna characteristic or MST antenna characteristic). In the case of the second portable device and the third portable device in which the antenna module 100 is disposed to be spaced apart from the short side of the rear cover 200 by the first interval or the second interval, the antenna performance deteriorates as compared to the first portable device, however, the minimum reference level or more of antenna characteristic for performing communication (that is, NFC or MST communication) may be implemented.

This means that as the interval between the antenna module 100 and the short side of the back cover 200 is decreased, the antenna performance is improved, and as the interval between the antenna module 100 and the short side of the back cover 200 is increased, the antenna performance deteriorates.

By doing so, as the antenna module 100 is disposed (aligned) closer to the short side of the back cover 200, the portable device may implement optimal antenna performance, and in the case in which the antenna module 100 is disposed to be spaced apart by an interval exceeding the second interval, normal communication (that is, NFC or MST communication) may not be performed due to the level of antenna performance that is less than the minimum reference level.

Next, the antenna performance of the portable device depending on the disposition positions of the antenna module 100 and the support board 300 will be compared and described below with reference to FIGS. 21 to 25.

The antenna module 100 is disposed to be collinearly positioned with the short side of the back cover 200 (that is, the state in which an interval between the antenna module 100 and the short side of the back cover 200 is 0 mm). Accordingly, the back cover 200 covers the entire antenna module 100.

In a state in which the antenna module 100 is disposed to be collinearly positioned with the short side of the back cover 200, the interval between the antenna module 100 and a short side of the support board 300 (that is, the interval of an x-axis) is changed from −15 mm to 15 mm by 5 mm. Here, in FIG. 21, the interval between the antenna module 100 and the short side of the support board 300 is −15 mm, in FIG. 22, the interval between the antenna module 100 and the short side of the support board 300 is 0 mm, and in FIG. 23, the interval between the antenna module 100 and the short side of the support board 300 is 15 mm.

If the antenna module 100 does not overlap the support board 300 (that is, the interval between the short side of the support board 300 and the antenna module 100 is about −15 mm to −10 mm), interference of the support board 300 in the radiation field (magnetic field) is decreased, thereby improving the antenna performance.

If the antenna module 100 is positioned at an inner side on the support board 300 (that is, the interval between the short side of the support board 300 and the antenna module 100 is about 5 mm or more), the radiation field is shielded in the front surface direction of the portable device by the support board 300, such that the radiation field (magnetic field) is concentrated in a main body direction of the portable device (that is, the front surface direction of the portable device) thereby improving the antenna performance.

For example, as illustrated in FIG. 24, an antenna performance depending on the disposition position of the antenna module 100 operated as the NFC antenna and the support board 300 was measured, and as a result, it may be appreciated that the minimum reference level or more of antenna performance for NFC is implemented regardless of the distance (interval) between the antenna module 100 and the short side of the support board 300.

At this time, as the distance (interval) between the antenna module 100 and the short side of the support board 300 is increased, the antenna performance is improved, and this means that the antenna performance is improved as the support board 300 does not exist or the support board 300 is formed to have a wider area than the antenna module 100.

As illustrated in FIG. 25, an antenna characteristic was measured in the main body direction (that is, the front surface direction of the portable device) of the portable device in which the antenna module 100 operated as an NFC antenna is mounted, and the back cover 200 direction (that is, the back surface direction of the portable device), and as a result, it may be appreciated that as the interval between the antenna module 100 and the short side of the back cover 200 is maintained as 0 mm, and the interval (that is, the interval of x-axis) between the antenna module 100 and the short side of the support board 300 is changed from 0 mm to 15 mm by 5 mm, the antenna performance in the main body direction deteriorates and the antenna characteristic in the back cover 200 direction is increased.

This means that as the antenna module 100 is disposed at an inner side on the support board 300, and the interval between the antenna module 100 and the short side of the support board 300 is increased, the radiation field is formed in the back cover 200 direction, thereby improving a concentration level.

Figure 26:
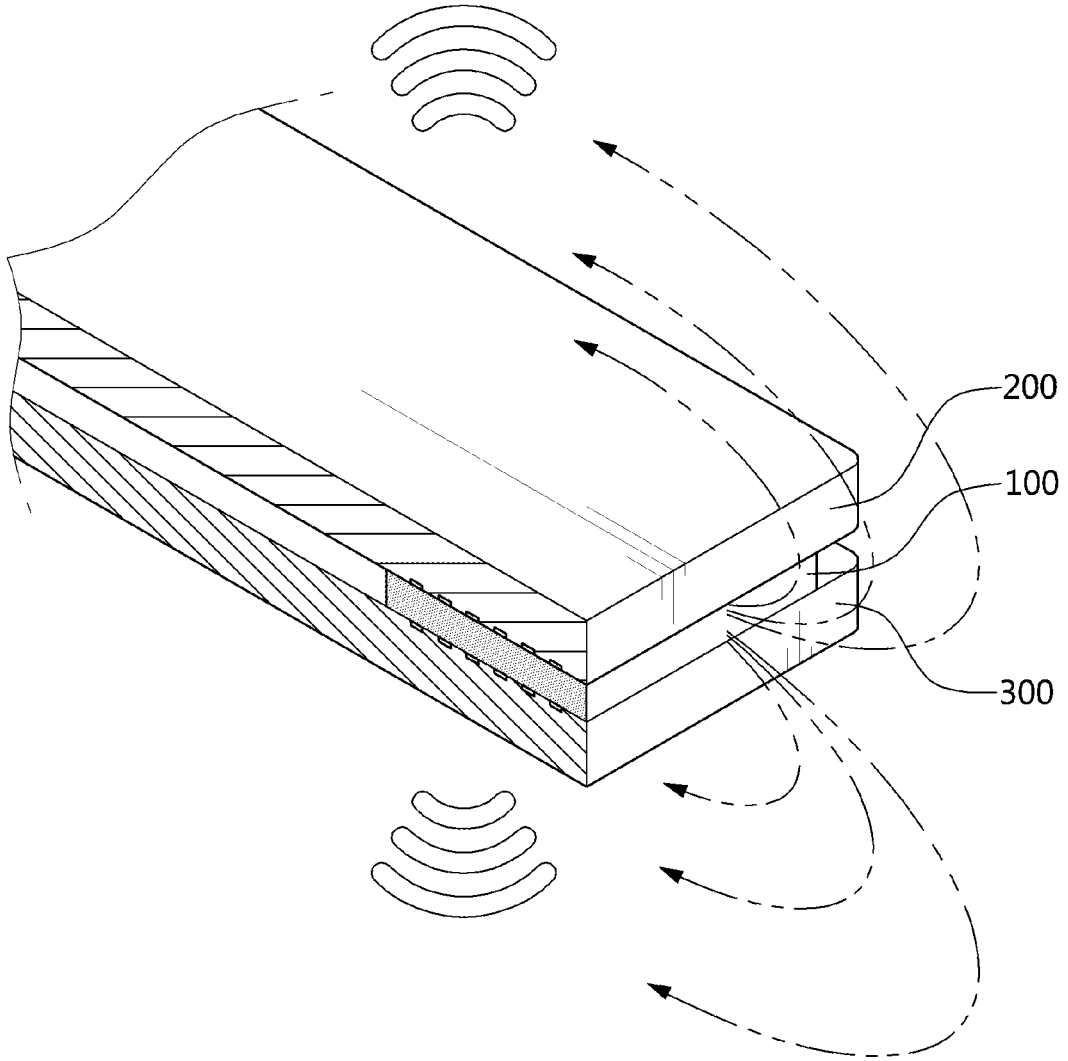

As illustrated in FIG. 26, if the antenna module 100 is collinearly disposed with the short side of the support board 300, the antenna module 100 implements the equivalent level of antenna characteristic in the main body direction and the back cover 200 direction, and may implement the minimum reference level or more of antenna characteristic for performing NFC.

Figure 27:
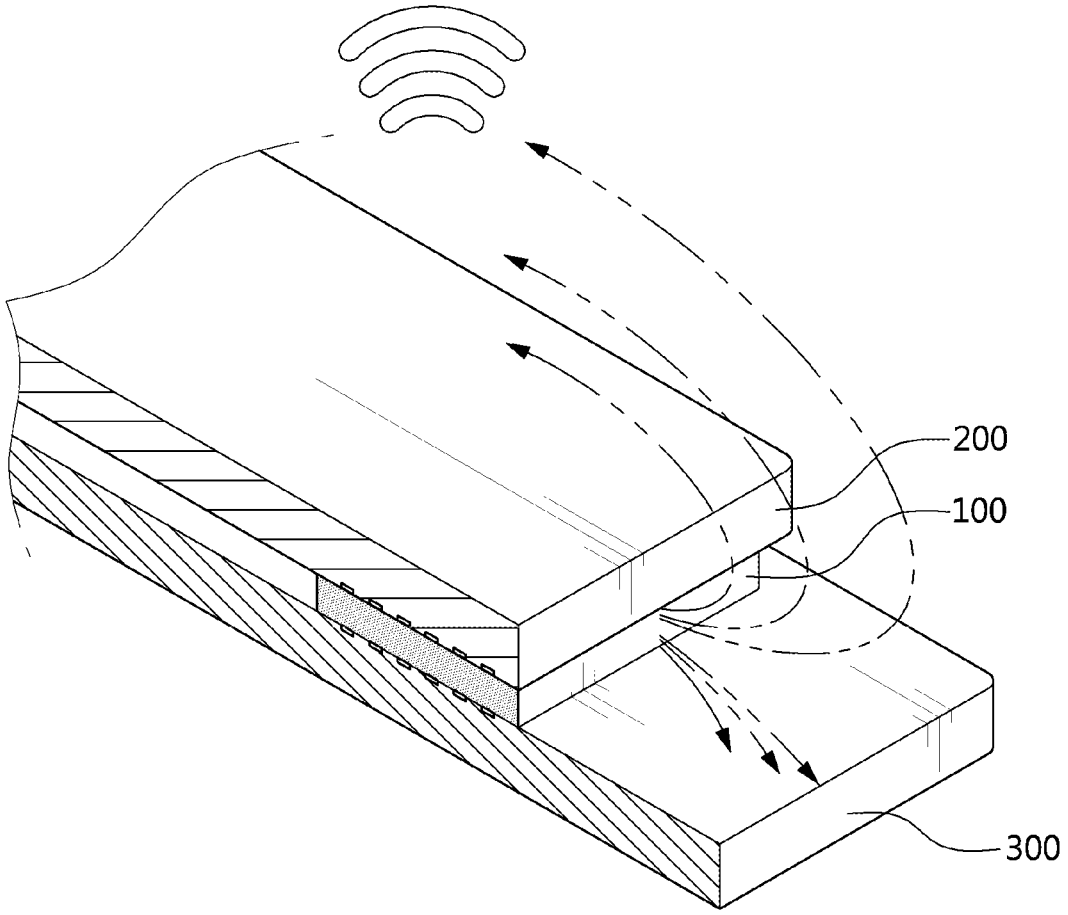

As illustrated in FIG. 27, if the antenna module 100 is disposed at the inner side on the support board 300, the magnetic field of the antenna module 100 in the main body direction is shielded by the support board 300, thereby deteriorating the antenna performance in the main body direction.

However, in the antenna module 100, the radiation field (magnetic field) is concentrated in the back cover 200 direction, thereby improving the antenna performance. That is, the antenna performance in the back surface direction may be improved by disposing the antenna module 100 at the inner side on the support board 300 to concentrate the radiation field on the back surface of the portable device.

Figure 28:
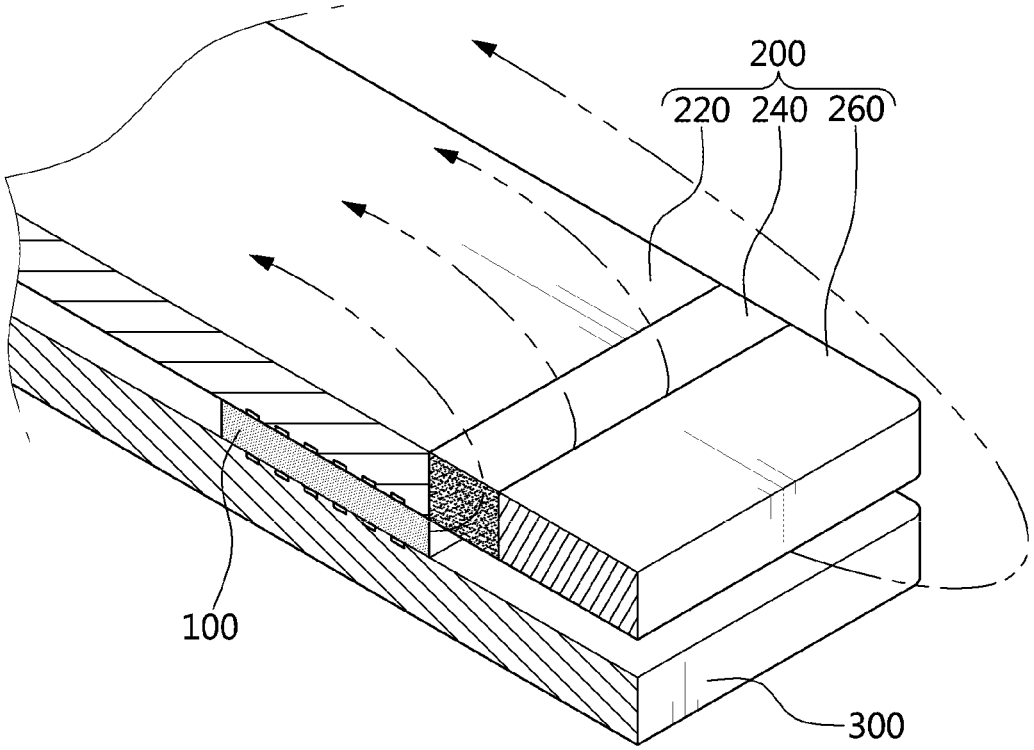

Meanwhile, as illustrated in FIG. 28, if the back cover 200 is configured of the first cover 220 and the second cover 240, and the antenna module 100 is collinearly disposed with a short side of the first cover 220, the antenna module 100 forms a magnetic field at the gap 260 between the first cover 220 and the second cover 240. Accordingly, the portable device may implement an equivalent level or more of antenna performance to the case of using the back cover 200 made of a non-metallic material.

Figure 29:
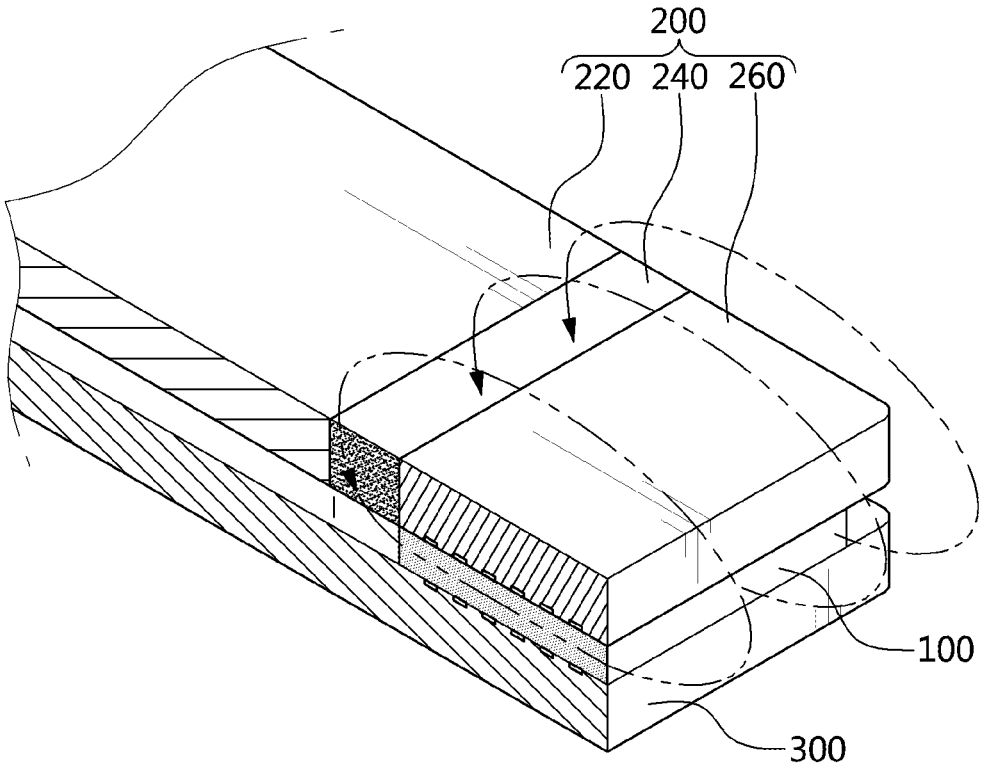

As illustrated in FIG. 29, if the back cover 200 is configured of the first cover 220 and the second cover 240, and the antenna module 100 is collinearly disposed with a short side of the second cover 240, the antenna module 100 forms a magnetic field at both sides of the second cover 240. Accordingly, the portable device may implement an equivalent level or more of antenna performance to the case of using the back cover 200 made of a non-metallic material.

For example, as illustrated in FIG. 30, if the antenna module 100 is collinearly disposed with the first cover 220 (that is, if the interval between the short side of the first cover 220 and the antenna module 100 is 0 mm, and the interval between the short side of the support board 300 and the antenna module 100 is 10 mm), the portable device may implement an equivalent level of antenna performance regardless of a material of the second cover 240.

Further if the antenna module 100 is collinearly disposed with the second cover 240 (that is, if the interval between the short side of the first cover 220 and the antenna module 100 is 10 mm, and the interval between the short side of the support board 300 and the antenna module 100 is 0 mm), the portable device may implement an equivalent level of antenna performance regardless of a material of the second cover 240.

As described above, the portable device has the antenna module 100 in which the radiation pattern 140 is alternately formed on the upper surface and the lower surface of the shielding sheet 120 to be wound on the shielding sheet 120 in the vertical direction mounted therein, such that the equivalent level of antenna characteristic can be implemented even in the case in which the material (that is, metal material and non-metallic material) of the back cover is changed.

Further, the portable device implements the equivalent level of antenna characteristic regardless of the material of the cover by using the antenna module 100, thereby minimizing restriction on design for implementing the antenna performance to maximize mass-productivity of the portable device.

Further, the portable device has the antenna module 100 in which the radiation pattern 140 is alternately formed on the upper surface and the lower surface of the shielding sheet 120 to be wound on the shielding sheet 120 in the vertical direction mounted therein, thereby implementing the antenna performance at various angles such as a front surface, a back surface, side surfaces, and the like of the portable device to maximize convenience of a user at the time of performing near field communication and electronic payment.

Hereinabove, the preferred embodiments according to the present invention have been described, but various modifications may be made, and it is understood that a person having ordinary skill in the art may practice various modifications and changes without departing from the scope of claims of the present invention.

The invention claimed is:

1. An antenna module, comprising:

a shielding sheet; and a radiation pattern in which coils are alternately formed on an upper surface and a lower surface of the shielding sheet to be wound in a vertical direction of the shielding sheet, wherein the antenna module is disposed between a back cover and a support board of a portable device, one side of the antenna module is collinearly disposed with a short side of the back cover, and the other side of the antenna module is collinearly disposed with a short side of the support board.

2. The antenna module of claim 1, wherein the radiation pattern comprises a plurality of first coils formed to be spaced apart from each other on one surface of the shielding sheet;

a plurality of second coils formed to be spaced apart from each other on one side surface of the shielding sheet and each having one end connected to one of the plurality of first coils;

a plurality of third coils formed to be spaced apart from each other on the other surface opposite to the one surface of the shielding sheet and each having one end connected to one of the plurality of second coils; and a plurality of fourth coils formed to be spaced apart from each other on the other side surface opposite to the one side surface of the shielding sheet and each having one end connected to one of the plurality of third coils and the other end connected to one of the plurality of first coils.

3. The antenna module of claim 2, wherein at least one of the plurality of first coils that is adjacent to another side surface of the shielding sheet has one end connected to one of the plurality of second coils and the other end connected to a terminal portion.

4. The antenna module of claim 2, wherein at least one of the plurality of third coils that is adjacent to another side surface of the shielding sheet has one end connected to one of the plurality of second coils and the other end connected to a terminal portion.

5. A portable device, comprising:

a back cover formed of a metal material; and an antenna module having a radiation pattern formed along a short side direction of the back cover, and mounted to be biased from the center of the back cover to a short side of the back cover;

a support board having a short side disposed to be spaced apart from a short side of the back cover, wherein the antenna module is mounted so that one side thereof is collinearly disposed with the short side of the back cover and the other side thereof is collinearly disposed with the short side of the support board.

6. The portable device of claim 5, further comprising:

a support board, wherein the antenna module is interposed between the back cover and the support board.

7. The portable device of claim 6, wherein one side of the antenna module is collinearly disposed with the short side of the back cover and a short side of the support board.

8. The portable device of claim 6, wherein one side of the antenna module is collinearly disposed with a short side of the back cover, and a short side of the support board is disposed to be spaced apart from one side of the antenna module and the short side of the back cover.

9. The portable device of claim 5, wherein the back cover comprises a first cover formed of a metal material; and a second cover formed to be spaced apart from the first cover.

10. The portable device of claim 9, wherein the back cover further comprises a gap formed between the first cover and the second cover and filled with a non-metallic material.

11. The portable device of claim 9, wherein the antenna module is mounted to be biased to one side of the first cover adjacent to the second cover and forms a radiation field at a gap between the first cover and the second cover.

12. The portable device of claim 9, wherein the antenna module is mounted to be biased to one side of the second cover opposing to a side of the second cover adjacent to the first cover and forms a radiation field at one side and the other side of the second cover.

* * * * *